United States Patent [19]

Stuckmann et al.

[11] 4,048,806

[45] Sept. 20, 1977

[54] APPARATUS FOR, AND A METHOD OF, DRIVING TUNNELS

[75] Inventors: Dieter Stuckmann, Selm; Siegmund Babendererde, Bad Vilbel; Hans Jütte, Dortmund-Brechten; Reinhard Bokemeyer, Offenbach, all of Germany

[73] Assignees: Gewerkschaft Eisenhutte Westfalia, Wethmar near Lunen; Hochtief A.G., Frankfurt, both of Germany

[21] Appl. No.: 684,826

[22] Filed: May 10, 1976

[30] Foreign Application Priority Data

May 10, 1975 Germany ..... 2520915

[51] Int. Cl.[2] ..... E21D 9/06

[52] U.S. Cl. ..... 61/85; 299/31

[58] Field of Search ..... 61/85, 41, 42; 299/33, 299/11

[56] References Cited

U.S. PATENT DOCUMENTS

| | | | |
|---|---|---|---|
| 3,903,707 | 9/1975 | Folk | 61/85 |
| 3,926,005 | 12/1975 | Folk | 61/85 |

FOREIGN PATENT DOCUMENTS

| | | | |
|---|---|---|---|
| 1,203,300 | 10/1965 | Germany | 299/33 |
| 621,064 | 11/1935 | Germany | 61/85 |

*Primary Examiner*—Jacob Shapiro

*Attorney, Agent, or Firm*—Sughrue, Rothwell, Mion, Zinn and Macpeak

[57] ABSTRACT

Tunnel driving apparatus has a shield with a plurality of cutter planks arranged side-by-side around the tunnel axis. The planks are supported and guided by two frames connected via a rigid bracing structure. One of the frames is provided with adjustable means capable of expanding or contacting the frame radially of the tunnel axis. The planks are advanced in known manner individually or in groups and the adjustable frame can be used to make the axes of the planks converge rearwardly of the tunnel driving direction when desired. Such control permits steering of the apparatus by making the reactive forces on the advancing planks cant the shield within a tapered gap between the planks and the tunnel wall. In addition the tendency of the frames to become jammed in the planks when being shifted up can be precluded.

16 Claims, 5 Drawing Figures

FIG.1
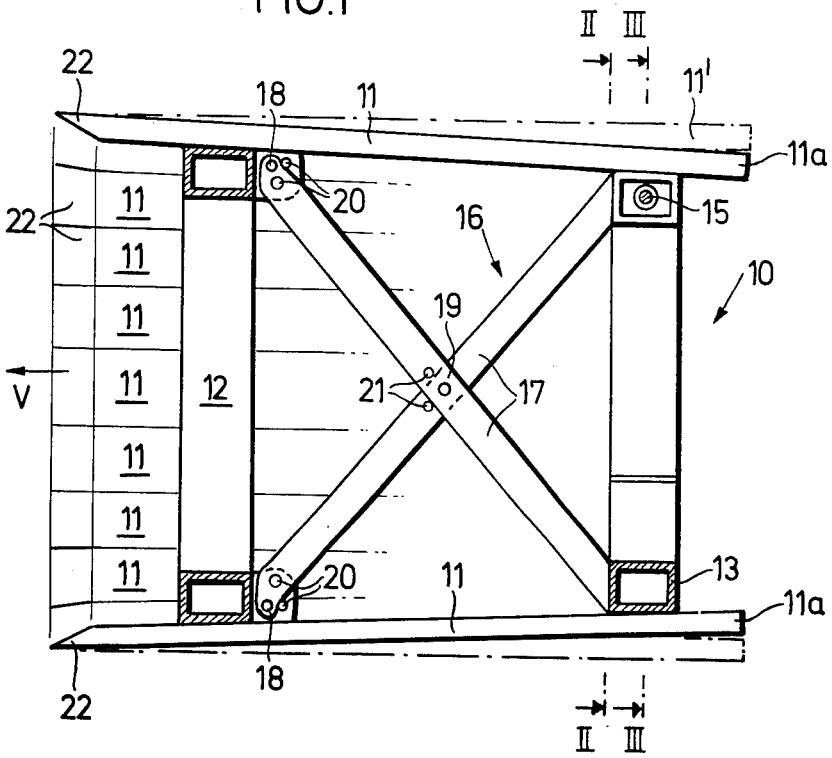
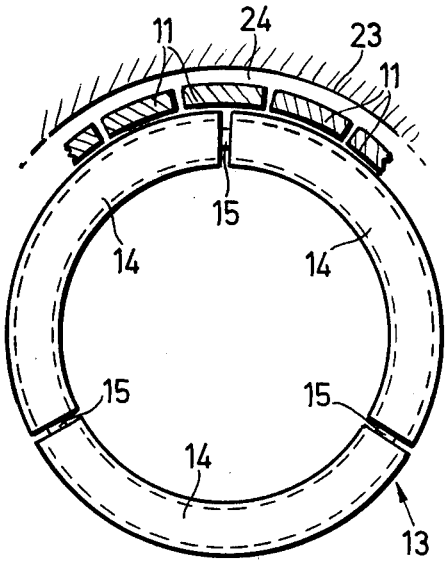
FIG.2
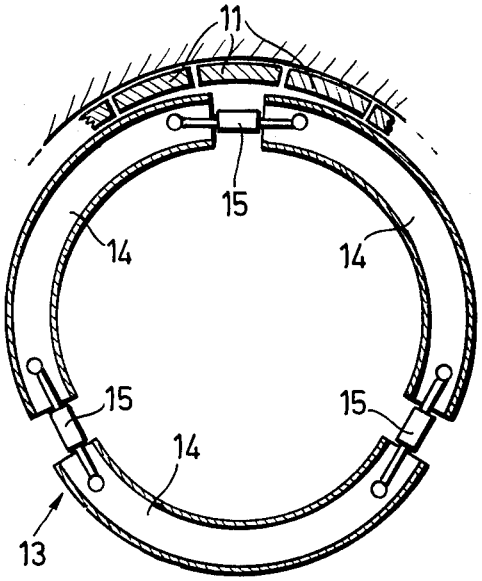
FIG.3

FIG. 4
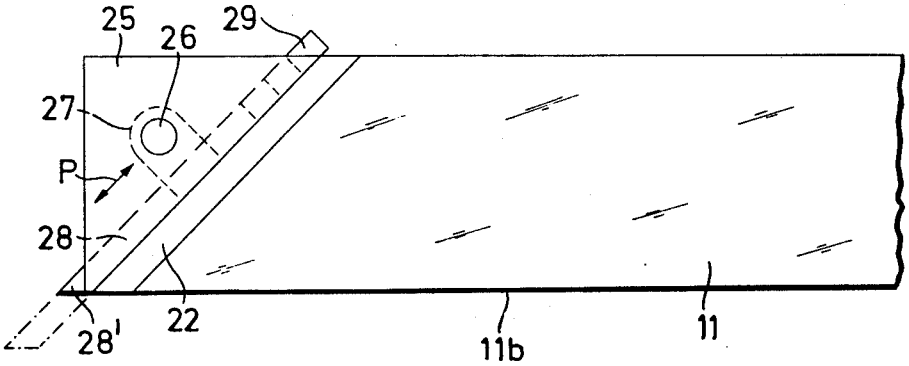
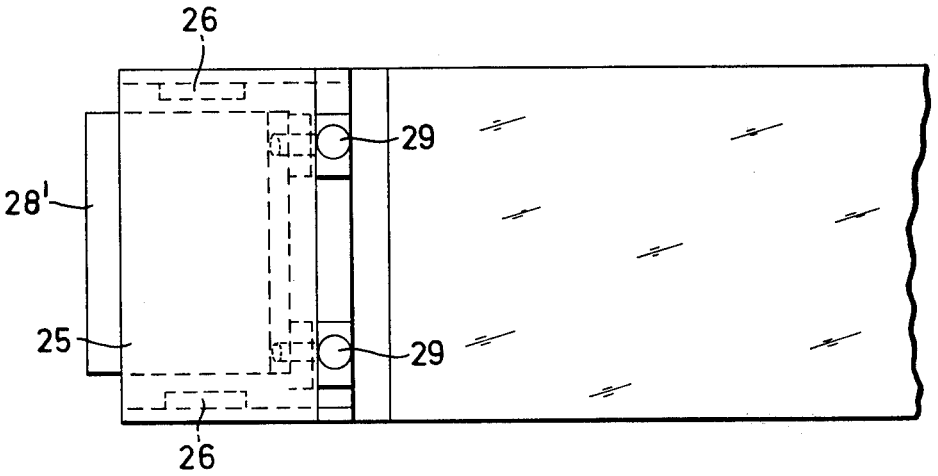
FIG. 5

APPARATUS FOR, AND A METHOD OF, DRIVING TUNNELS

BACKGROUND OF THE INVENTION

The present invention relates to apparatus for, and a method of, driving galleries, tunnels and other similar underground cavities hereinafter collectively referred to as tunnels.

In tunnel driving it is known to employ shields composed of a plurality of elongate cutter planks arranged side-by-side and supported and guided by one or more frames. The planks contact and define the tunnel wall and the tunnel advancement is effected by driving or displacing the planks forwardly individually or in groups in their longitudinal direction. To move the planks use can be made of hydraulic piston and cylinder units connected between the support frame or frames and a further separate frame disposed rearwardly of the tunnel working face relative to the support frame or frames. The further frame can then be moved in relation to the support frame or frames. The further frame can then be moved in relation to the support frame or frames or vice versa by operating the units by selectively locking the planks to the further frame advancement of the planks or of the support frame or frames can be achieved. When the support frame or frames are moved up within the planks it is known for the frame or frames to become jammed or blocked within the planks. Another difficulty encountered with apparatus of the kind described is the efficient control or steering of the direction of driving of the tunnel.

A general object of this invention is to provide an improved apparatus for and method of tunnel driving.

SUMMARY OF THE INVENTION

In one aspect the invention provides tunnel driving apparatus having a shield composed of a plurality of elongate members arranged in side-by-side relationship, means for supporting the members and for guiding the members for longitudinal displacement in the tunnel driving operation and adjustable means for varying the position of the members in relation to the support means so that the elongate members can all be inclined in relation to the longitudinal central axis of the apparatus or adopt a position parallel to said central axis.

In another aspect, the invention provides tunnel driving apparatus which has a shield composed of a plurality of elongate members arranged in side-by-side relationship and capable of contacting the tunnel wall, first and second frames spaced along the longitudinal central axis of the shield, the frames serving to support and guide the members for longitudinal displacement and adjustable means for varying the size of one of the frames in relation to the other to thereby control the inclination of all of the elongate members relative to the central axis of the shield.

The elongate members can be set with their axes parallel or converging by the adjustable means.

The invention also provides a method of driving a tunnel utilizing a shield with a plurality of elongate members arranged side-by-side and guided for longitudinal movement by support means; said method comprising advancing the members individually or in groups and adjusting the support means to control the inclination of all the members simultaneously in relation to the longitudinal central axis of the shield.

In contrast to the known apparatus the support means or frame can be adjusted to cause the axes of the members to converge rearwardly of the advancing direction to thereby preclude jamming of the support means when the support means is moved up to follow the advancement of the tunnel.

The setting of the members in the inclined position can create a tapered gap between the exterior of the members and the surrounding tunnel wall capable of inhibiting the tendency of the support means or frames to jam or become blocked when moved. This tapered gap also permits steering of the shield and control of the tunnel driving direction and can be achieved by advancing selected groups of members and relying upon the reactive forces on these members to tilt the shield in the direction of the region of the tunnel associated with these members. This effect can be enhanced by modifying the members which normally have cutting edges at their front ends, so that they have detachable shoes preferably with adjustable cutter blades or plates at the front ends capable of projecting outwardly from the member itself.

Where the material in which the tunnel is being driven is particularly loose or liable to subsidence it is unwise to provide a large tapered gap between the members and the tunnel wall. Nevertheless, the adjustable means, which can be hydraulically powered, is preferably capable of altering the size of the gap, if any, with sufficient control to preclude damage. It is also possible to relieve the hydraulic circuit perhaps cyclically without altering the position of the elongate members to any great extend but sufficiently to permit the support means thereof to be shifted up without jamming. Otherwise the driving operation can be effected in difficult materials with the members more or less set in parallel relationship to provide a cylindrical rather than a frusto-conical shield. Where conditions permit however the adjustable means can be used to make the members assume an inclined disposition with the advantages discussed above.

Preferably the support means of an apparatus made in accordance with the invention has frames one of which is provided with adjustable means which effects a radial expansion or contraction of the frame in relation to the central axis. This one frame can be, in one constructional form, a ring-like structure with segmental components interconnected by said adjustable means which serves to effect relative movement between the adjacent ends of the components. Normally this one frame would be disposed rearwardly of the other frame in relation to the direction of tunnel advancement and the adjustable means can be set to make axes of the elongate members converge in the rearward direction or extend parallel to one another.

The individual frames of the support means may be interconnected by a bracing structure able to pivot to cope with the adjustments referred to. Thus, the structure may comprise struts rigidly connected to one of the frames and articulated to the other. It is however desirable to stiffen the structure when the adjustable means is not operated and here pins can be inserted into alignable bores between the struts and between the struts and the articulatedly-connected frame.

The invention also provides tunnel driving apparatus having a shield composed of a plurality of elongate drive members arranged in side-by-side relationship to define and contact the tunnel wall, support means for supporting and guiding the members for longitudinal displacement and adjustable means for varying the angular relationship between all the members and the tunnel axis in unison.

The invention may be understood more readily and various other features of the invention may become apparent from consideration of the following description.

BRIEF DESCRIPTION OF DRAWINGS

An embodiment of the invention will now be described, by way of example only, with reference to the accompanying drawings, wherein:

FIG. 1 is a diagrammatic part sectional side view of apparatus made in accordance with the invention;

FIG. 2 is a sectional view of the apparatus with the rear frame therof in an expanded, i.e., contracted condition, the view being taken along the line II—II of FIG. 1;

FIG. 3 is a sectional view of the apparatus with the rear frame thereof in an expanded condition, the view being taken along the line II—II of FIG. 1;

FIG. 4 is a diagrammatic side view of the forward region of a modified elongate member of the apparatus; and FIG. 5 is a diagrammatic plan view of the forward region of a modified elongate member of the apparatus; and FIG. 5 is a diagrammatic plan view of the forward region of the elongate member illustrated in FIG. 4.

DESCRIPTION OF PREFERRED EMBODIMENT

The apparatus as represented in FIGS. 1 to 3, takes the form of a crib shield 10 for use in driving underground tunnels and the like. The shield 10 is composed of a series of elongate drive members or cutter planks 11 which are arranged side-by-side in known manner and which are carried by frames 12, 13. The forward ends of the planks 11 are provided with cutting edges 22 and the planks 11 serve to support the tunnel wall and to effect advancement of the tunnel. The planks 11 are guided for longitudinal relative parallel motion and motion in relation to the frames 12, 13. The planks 11 can be advanced in the direction of arrow V FIG. 1 either individually or in groups by shifting means (not shown). One type of known shifting means for the planks 11 comprises double-acting hydraulic piston and cylinder units or rams which are connected between the shield 10 and a further movable framework disposed rearwardly of the shield 10 and having means for selectively connecting the individual planks 11 thereto. The construction and operation of such arrangements is known per se and described in published literature.

The first or front frame 12 is a rigid hollow ring with a rectangular cross-section as shown in FIG. 1. The second or rear frame 13 has an overall ring-like hollow configuration similar to the frame 12 but the frame 13 is composed of and sub-divided into three segmental components 14 (FIG. 3) connected together at their respective ends with the aid of adjustment means 15 capable of moving the components 14 together or apart thereby expanding or contracting the frame 12. The adjustment means 15 can take the form of hydraulic piston and cylinder units or mechanical spindles or screws for example.

The relative positions of the components 14 represented in FIGS. 2 and 3 depict the contacted and expanded conditions of the rear frame 12 respectively. The adjustment means 15 can be arranged so as to be protected partly within the components 14 as represented in FIG. 2.

As shown in FIG. 1, the frames 12, 13 are interconnected by means of a bracing structure 16. This bracing structure 16 consists of rigid bars or struts 17 extending in diagonal fashion and connected to the frames 12, 13. The struts 17 are rigidly affixed to the frame 13 or rather components thereof. The struts 17 are, in contrast, articulated to the frame 12 with the aid of pivot pins 18. At their intersection zone 19 the struts 17 are unconnected or at least relatively displaceable when desired. Thus, the rear frame 13 can adopt its expanded or contracted condition whenever desired and the operation of the adjusting means 15 will not subject the struts 17 to any bending force. Nevertheless whilst it is desirable to allow the structs 17 to displace to follow any change in the condition of the frame 13, i.e., whenever the means 15 is operated, it is preferred to stiffen the structure 16 when the frame 13 has been set to its desired state. To achieve this latter objective, locking pins or the like can be inserted into staggered alignable holes 20 in the struts 17 and the frame 12 and into staggered holes 21 in the intersection zone 19 between the struts 17. When the rear frame 13 is in the unexpanded or contracted condition, as shown in FIG. 2, its external diameter is smaller that that of the frame 12. Consequently, as shown in FIG. 1, the planks 11 are caused to assume a slightly inclined position in relation to the central longitudinal axis of the shield 10 and the driving direction V. Thus, each plank 11 diverges from the tunnel wall in a direction from the working face to the rear, i.e., from the front frame 12 to the rear frame 13. As a result the axes of the members 11 converge rearwardly so that a tapered gap 24 (FIG. 2) is established between the planks 11 and the surrounding tunnel wall 23. The rear ends 11*a* of the planks 11 which are always within the range of the rear framework constituting part of their shifting means are spaced furthest from the wall 23. By arranging the planks 11 in this manner the tendency of the shield or rather the support means, i.e., the frames 12, 13 to become blocked or jammed is precluded, when the latter is shifted up in the advanced members 11. The exact amount of inclination for the planks 11 depends upon local conditions and the means 15 preferably permits some measure of fine control. Where, for example, the tunnel is being driven in unstable ground subsidence could occur and here it would be best to have a slight taper or even no taper at all as represented by the chain dotted line 11′ in FIG. 1. This would necessitate expanding the frame 13 to its maximum or near-maximum size. Where the planks 11 have been advanced and it is desired to shift up the frames 12, 13 then to preclude jamming of these frames 12, 13 within the planks 11, but without involving the possibility of subsidence by creating the tapered gap 24, the means 15 can be operated, perhaps in successive cycles, to briefly relieve the full expansion force on the frame 13 and this will tend to meet the objectives. As mentioned before any operation of the means 15 should be preceded by removing the locking pins serving to stiffen the bracing structure 16.

The possibility of creating the tapered gap 24 also permits steering or control of the direction of driving of the tunnel by utilizing the reactive forces acting on the planks 11 when these are advanced. If, for example, it is desirable to move the apparatus towards the lower floor region of the tunnel (FIG. 1) then the planks 11 arranged over this floor region are advanced first and this tends to cant the shield apparatus accordingly.

FIGS. 4 and 5 depict a different modified form of cutter plank which is constructed to enhance the reactive moment acting as the forward region of the plank. Thus, as illustrated the plank 11 has as its forward region a block or shoe 25 detachably secured to the remainder of the plank 11 with the aid of a bolt 26 which is received by apertured eyes 27 on the plank body 11. The shoe 25 has a wedge-shaped triangular profile and effectively blunts the normal tapered cutting edge 22 of the plank 11. This tends to increase the reactive force on the forward region of the plank 11 when it is thrust forwards and the resultant torque or moment exerted on the shield 10 will be correspondingly increased. Between the shoe 25 and the cutting edge 22 a cutter blade or plate 28 is preferably arranged. The plate 28 can be accommodated in a slot or recess in the shoe 25 and the plate 28 can be slidably displaced into or out from the slot (arrow P FIG. 4) into various positions. Provision is made to secure the plate 28 in any desired position. Thus, as shown in FIG. 4, the plate 28 is secured in a position where its cutting edge 28' extends outwardly beyond the lower surface 11*b* of the plank 11. The adjustment and securing of the plate 28 can be accomplished with screw threaded devices 29. The shoe 25 and its cutting plate 28 can be selectively attached to the planks 11 which extend over the region towards which it is desired to steer the shield 10. For example, the planks 11 at the lower region adjacent the tunnel floor can be converted in this way to steer the shield 10 downwards towards the floor. When the corrective steering has been accomplished to the desired extent the shoes 25 can be removed and subsequently re-used in case of need.

We claim:

1. Tunnel driving apparatus having a shield composed of a plurality of elongate drive members arranged in side-by-side supporting and guiding all the members for longitudinal displacement and adjustable means on part of said support means for varying the angular relationship between the individual longitudinal axes of all the members and the tunnel axis in unison.

2. Tunnel driving apparatus with a shield composed of a plurality of elongate members arranged in side-by-side relationship for contacting the wall of a tunnel, first and second frames spaced apart along the longitudinal central axis of the shield, the frames serving to support and guide the members for longitudinal displacement and adjustable means for varying the effective size of one of the frames in relation to the other to bring all the axes of the elongate members into a parallel relationship or into a relationship where the said axes converge in a rearward direction relative to the direction of tunnel advancement.

3. Apparatus according to claim 2, wherein the adjustable means serves to radially expand or contract said one frame in relation to the central axis.

4. Apparatus according to claim 3, wherein said one frame is of ring-like configuration with segmental components interconnected by said adjustable means which serves to effect relative movement between the adjacent ends of the components.

5. Apparatus according to claim 2, wherein said one frame is disposed rearwardly of the other frame in relation to the direction of tunnel advancement.

6. Apparatus according to claim 2, wherein the frames are interconnected by a bracing structure which is capable of compensatory displacement when the adjustable means is operated.

7. Apparatus according to claim 6, and further comprising selective means for making the bracing structure wholly rigid in relation to the frames.

8. Apparatus according to claim 6, wherein the bracing structure is composed of struts connected between the frames in a diagonal manner to intersect at a central region between the frames, each strut being rigidly connected to one frame and articulated to another frame and wherein detachable locking means serve to rigidly connect the struts to the other frame and to one another when desired.

9. Apparatus according to claim 2, wherein at least some of the elongate members each has at its front end a detachable shoe carrying an adjustable cutter plate capable of projecting from a surface of the member.

10. A method of driving a tunnel utilizing apparatus according to claim 2; said method comprising advancing the elongate members individually or in groups, shifting up the frames to follow up the members after advancement and operating the adjusting means to control the inclination of all the members simultaneously to make the axes of the members converge rearwardly of the advancing direction to preclude jamming of the frames when the frames are shifted up.

11. A method of driving a tunnel utilizing apparatus according to claim 2; said method comprising advancing the elongate members individually or in groups, shifting up the frames to follow up the members after advancement, operating the adjusting means to vary the inclination of all the members simultaneously to create a tapered gap between the members and the tunnel wall and advancing selected members in relation to the remaining members to control the direction of the tunnel.

12. A method according to claim 11, wherein the selected members are those in the region towards which the shield is to be steered to control the direction of the tunnel and the reactive forces on the forward ends of these members are utilized to create a moment on the shield which is able to cant within the tapered gap.

13. A method according to claim 12, wherein shoes with adjustable cutter plates are attached to the front ends of the selected members prior to their advancement to enhance the effect of the reactive forces thereon and optimize the steering control.

14. In a tunnel driving apparatus with a shield composed of a plurality of elongate members arranged in side-by-side relationship and capable of contacting and supporting the wall of a tunnel, and means supporting and guiding the members for longitudinal displacement in the driving direction; the improvements comprising the means for supporting and guiding the elongate members takes the form of first and second frames spaced apart in the tunnel driving direction and one of the frames is provided with adjustable means for expanding or contracting the frame relative to the tunnel wall to thereby bring the elongate members into a position where their longitudinal axes all converge rearwardly of the tunnel driving direction.

15. Tunnel driving apparatus with a shield composed of a plurality of elongate members arranged in side-by-side relationship for contacting the wall of a tunnel, first and second frames spaced apart along the longitudinal central axis of the shield, the frames serving to support and guide the members for longitudinal displacement adjustable means for varying the effective size of one of the frames in relation to the other to bring all the axes of the elongate members into a parallel relationship or into a relationship where the said axes converge in a rearward direction relative to the direction of tunnel advancement, a bracing structure interconnecting the frames, said bracing structure being composed of struts connected between the frames in a diagonal manner to intersect at a central region between the frames, each strut being rigidly connected to one of the frames and articulated to the other of the frames and detachable locking means for rigidly interconnecting the struts to said other frame and to each other when desired.

16. Tunnel driving apparatus with a shield composed of a plurality of elongate members arranged side-by-side around a central longitudinal shield axes, frame means supporting and guiding all the members for individual longitudinal displacement in the tunnel driving direction and adjustment means acting on the frame means to displace all the elongate members over a rear zone symmetrically and simultaneously transversely of the shield axis whereby all the axes of the members can be brought into parallelism or into a relationship where their axes converge in a rearward direction relative to the tunnel driving direction.

* * * * *